US005806432A

United States Patent [19]

Kurth

[11] Patent Number: 5,806,432

[45] Date of Patent: Sep. 15, 1998

[54] PROCESS FOR CONVERTING AND PRINTING ON WEBS, AND A PRINTING MACHINE FOR CARRYING OUT THIS PROCESS

[75] Inventor: Dieter Kurth, Düsseldorf, Germany

[73] Assignee: Voith Sulzer Finishing GmbH, Krefeld, Germany

[21] Appl. No.: 739,691

[22] Filed: Oct. 29, 1996

[30] Foreign Application Priority Data

Nov. 13, 1995 [DE] Germany ..... 195 42 192.2
May 2, 1996 [DE] Germany ..... 196 17 601.8

[51] Int. Cl.[6] ..... B41F 13/54; B30B 15/34

[52] U.S. Cl. ..... 101/488; 100/35; 100/76; 162/206

[58] Field of Search ..... 101/483, 487, 101/488, 219, 224, 225, 226, 227, 228, 417, 424.1; 100/35, 38, 76; 162/204, 205, 206, 207, 265; 428/211

[56] References Cited

U.S. PATENT DOCUMENTS

| | | | |
|---|---|---|---|
| 2,347,047 | 4/1944 | Gessler et al. | 101/488 |
| 3,938,261 | 2/1976 | Anderson . | |
| 4,898,752 | 2/1990 | Cavagna . | |
| 4,966,352 | 10/1990 | Nuttin | 101/226 |
| 5,029,521 | 7/1991 | Pav et al. | 162/206 |
| 5,108,531 | 4/1992 | Quadracci | 101/488 |
| 5,385,771 | 1/1995 | Willetts et al. | 428/211 |

FOREIGN PATENT DOCUMENTS

| | | |
|---|---|---|
| 0 135 819 A2 | 8/1984 | European Pat. Off. . |
| 1015494 | 9/1963 | United Kingdom . |

OTHER PUBLICATIONS

"Die neuen Superkalanderkonzepte", Voith Sulzer Papiertechnik, 1994, No. May 1994 d.

*Primary Examiner*—Eugene H. Eickholt
*Attorney, Agent, or Firm*—Darby & Darby

[57] ABSTRACT

A process of converting and printing on paper webs includes converting the running web by coating and/or calendering the web. Printing of the web occurs directly after the converting step. Thus, the converted web is not wound into a roll between the converting step and the printing step. A facility for converting the web of paper is placed in front of the entrance to a printing machine. The pass-through speed of the converting facility matches that of the printing machine.

10 Claims, 2 Drawing Sheets

PROCESS FOR CONVERTING AND PRINTING ON WEBS, AND A PRINTING MACHINE FOR CARRYING OUT THIS PROCESS

BACKGROUND OF THE INVENTION

1. Field of the Invention

The present invention relates to a process for converting and printing on paper webs, and to a printing machine for printing on converted webs to carry out this process.

2. Discussion of the Related Art

Frequently, the base paper that exits a paper machine requires an additional conversion to account for the different requirements so that the paper can be printed on. The principle conversion processes are coating and calendering.

In coating, a coating dye that consists of pigments and fixing agents is applied, with the aid of a coating machine, to the base paper on one or both sides of the paper. Coating a base paper produces a closed and smooth, easily printable paper surface.

In calendering, smoothness and/or gloss are created, with the aid of a calender, on the surface of the base paper. Calendering a base paper increases the ability to apply ink during the printing process. Calenders typically have at least one roller gap, and preferably have several roller gaps. The roller gaps are defined by the juncture of a hard and soft roller. The hard rollers are preferably heatable rollers that are made of chill casting or steel. The soft rollers are preferably provided with a flexible outer covering. The web (e.g., the base paper) is subjected to a pressure treatment and, in most cases, a temperature treatment in these roll gaps, which create the desired smoothing of the web. Such calenders are generally well known. An example of such a calender is disclosed, for example, in German Reference DE-U-295 04 034.3.

Coating machines and calenders have conventionally been set up in paper factories and have been placed behind (i.e., downstream) with respect to a paper machine in the work sequence, either in-line or off-line. The converted web, which has a width corresponding to the paper machine, is formed into a roll in a wind-up device. During the winding-up process, there is a great deal of difficulty in creating a uniformly wound roll, particularly due to the fact that the web, because of its great surface smoothness, tends to slip sideways on a cushion of air that is present during the winding-up process.

To further process the web of paper in a printing plant, the rolls are usually cut, while still in the paper factory, into narrower rolls that match the width of the printing machines. The cutting of the roll is typically done by a roll-slitting machine, which divides the wide web that is unwound from a roll into separate partial webs by means of longitudinal cutters. Each of these separate partial webs are wound into a separate roll of lesser width in a winding station. With this second winding-up process there is still a tendency for the webs to slip sideways because of their relatively smooth surfaces.

The individual rolls that are made from the converted webs of paper must subsequently be individually packaged so that they can be transported to a printing plant in a protected manner. Additionally by packaging the individual rolls, the paper's moisture can be retained. Of course, this packaging of each individual roll is quite expensive.

Accordingly, it is an object of the present invention to improve the preparation of converted paper for printing.

SUMMARY OF THE INVENTION

This object is achieved in accordance with the present invention by converting the running web and subsequently printing thereon with no intermediate winding up process.

Thus, the method according to the present invention dispenses with the requirement of winding the converted paper into a roll. Shortly after the completion of the conversion treatment, the running web enters into the printing area. The individual rolling-up process in the paper factory is, thus, made substantially simpler because only the base paper has to be formed into a roll (i.e., wound-up). Because of the relatively rough surface and the greater volume of the base paper, it can be wound significantly more easily than paper that has been converted and is, therefore, smooth.

A further advantage of the present invention is the improved printing quality that can be achieved. Conventionally, it is practically impossible to avoid losing smoothness in the converted web of material during the long periods of storage and transport before the web was printed on in the printing process. This loss of smoothness can be attributed to the fact that the fibers, which have been leveled on the surface of the web, relax and stand up again over time. In accordance with the present invention, however, only a very short period of time exists between the conversion and the printing of the web. Thus, it is practically impossible for the surface fibers to stand up again during this relatively very short period of time. Thus, it is also possible to adjust or regulate the surface smoothness of the base paper so that it is optimally matched to the application of ink during printing.

The yet unconverted web is preferably cut to the width required for printing, formed into a roll, and drawn off this roll for conversion and printing. Thus, a wide web is cut into several partial webs in the paper factory as usual, but these partial webs have yet to be converted. Thus, the partial webs can be wound up easily. In addition, less expensive packaging can be used because the web has not yet reached its final conversion stage, and because the moisture content can still be used during the coating or calendering processing.

The converted web is optionally tempered before the printing step to achieve an especially good adapting of the web to the printing process.

The conversion can be achieved by calendering or coating, or through coating and subsequent calendering. The entire conversion is preferably carried out in the printing plant. But substantial advantages of the present invention can still be achieved even if only the concluding conversion treatment is carried out together with the printing during a single pass (in other words, a portion of the conversion has already been carried out in the paper factory).

In accordance with the present invention, a facility for the conversion of the web of paper is disposed in front of the entrance to the printing machine. The pass-through speed of the conversion facility matches that of the printing machine.

The conversion facility can be a coating device and/or a satinizing calender. In both cases, the surface of the web of paper is smoothed, which improves the printing process.

Because the pass-through speed of the conversion facility matches the pass-through speed of the printing machine, the conversion facility works comparatively slowly. In the case of a coating machine, the coating dye can be carefully applied with little effort. In the case of a calender, longer hold or dwell times of the web in the roller gap result, which leads to higher smoothness values. In addition, a calender that runs slower than calenders that are commonly used in paper factories is easier to manufacture and operate, and is less expensive to produce and operate.

The working width of the conversion facility is equal to or slightly greater than (i.e., is approximately equal to) that of the printing machine. Because the conversion facility can be allocated to a specific printing machine, the working width of the conversion facility can be matched to that of the printing machine. Thus, the conversion facility has a lesser width in comparison with the coating machines and calenders that have been commonly used in paper factories. Because of the smaller width, in combination with the slower speed, the conversion facility according to the present invention has markedly lower production costs.

In a further embodiment, a tempering facility, which affects the web temperature, is disposed between the exit of the conversion facility and the entrance to the printing machine.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
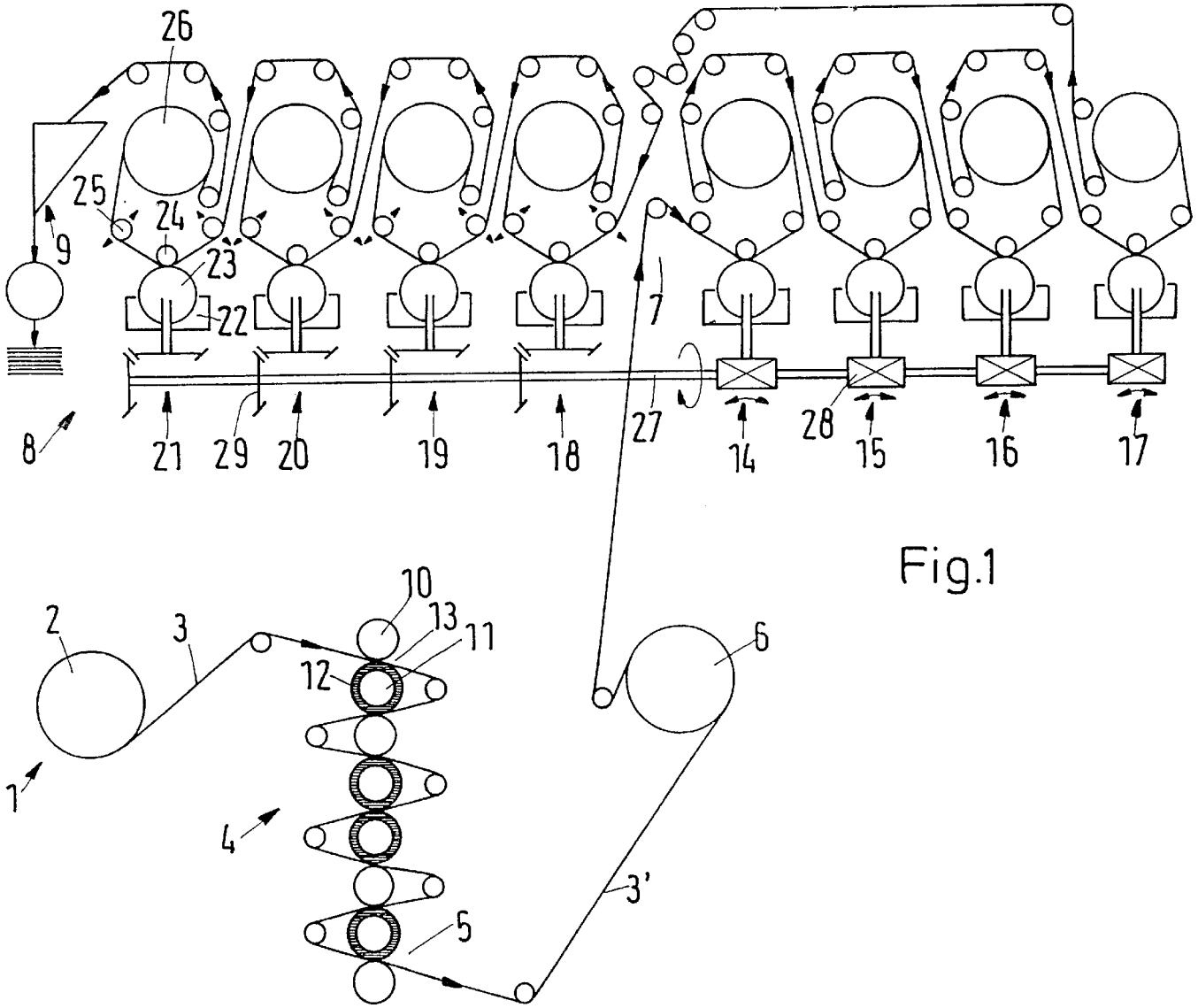
FIG. 1 is a schematic illustration of a combination calender and printing machine.

Referring now to FIG. 1, a winding off station 1 is illustrated. Wind-off station 1 includes a roll 2, which contains a web 3 of uncalendered (i.e., unconverted) paper. Web 3 runs through a calender 4. Web 3 leaves an exit 5 of the calender as a calendered web (i.e., a converted web 3'). Converted web 3' then winds, by an angle of more than 180°, around a tempering roller 6, which determines the web temperature. Thereafter, converted web 3' enters into an entrance 7 of a printing machine 8. Thereafter, converted web 3' enters into a folding apparatus 9, which is disposed at the end of the printing machine 8.

Calender 4 is comprised of hard rollers 10 and soft rollers 11. Hard rollers 10 are made of steel or chilled casting and are heated. Soft rollers 11 have a flexible outer covering 12. The rollers 10 and 11 are pressed in their working directions against each other by a device (not shown) so that the web 3 is affected by pressure and temperature in the roller gaps 13, and is smoothed as a result.

Printing machine 8 has four printing couples 14–17 for the first printing and four printing couples 18–21 for the second printing. Thus, printing machine 8 is an eight-color gravure, web-fed rotary press. The individual printing couples 14–21 each have engraved cylinders 23, which dip into ink troughs 22, in a conventional manner. In each printing couple, web 3' is guided between engraved cylinder 23 and an adjacent rubber impression cylinder 24, and, with the aid of tensioning means 25, is subsequently directed over at least one drying cylinder 26. Printing machine 8 has a common drive shaft 27, which drives the engraved cylinders 23 by means of appropriate transmissions 28 or 29.

A matching of the smoothness or gloss values to the requirements that have to be met for optimum printing in the printing machine 8 can be attained by regulating the pressure in the roll gap and/or the temperature of the hard rollers 10.

Figure 2:
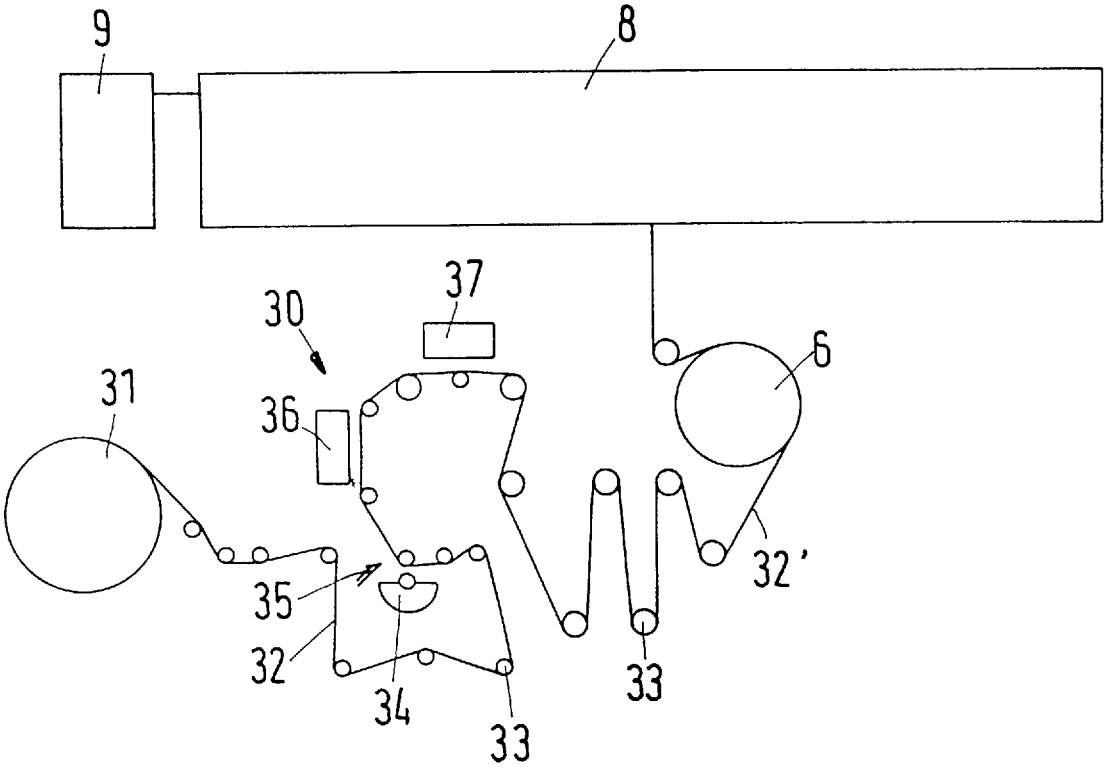
FIG. 2 is a schematic illustration of a combination coating machine and printing machine.

Referring now to FIG. 2, a coating machine 30 is illustrated. A winding-off station 31 is disposed upstream of (or in front of) coating machine 30 as viewed from the direction of movement of web 32. A printing machine 8 is disposed downstream from coating machine 30. Printing machine 8 corresponds to the printing machine 8 illustrated in FIG. 1, and terminates with a folding apparatus 9. Web 32 is unwound from winding off station 31 and enters into coating machine 30. Web 32 runs through a path, which is defined by guide rollers 33. Coating dyes are applied at a coating basin 34, and the excess is stripped off by means of a wiping blade 35. Subsequently, a first drying step is carried out in an infrared heating facility 36, and a second drying step is carried out in a hot-air drying facility 37. The now coated web 32' (i.e., a converted web 32') next winds partly around heating roller 6, and then enters printing machine 8. The web of paper is, thus, taken from a stored roll in an unwinding station 31, directed through a converting facility, namely, coating machine 30, and is then guided directly into printing machine 8.

Figure 3:
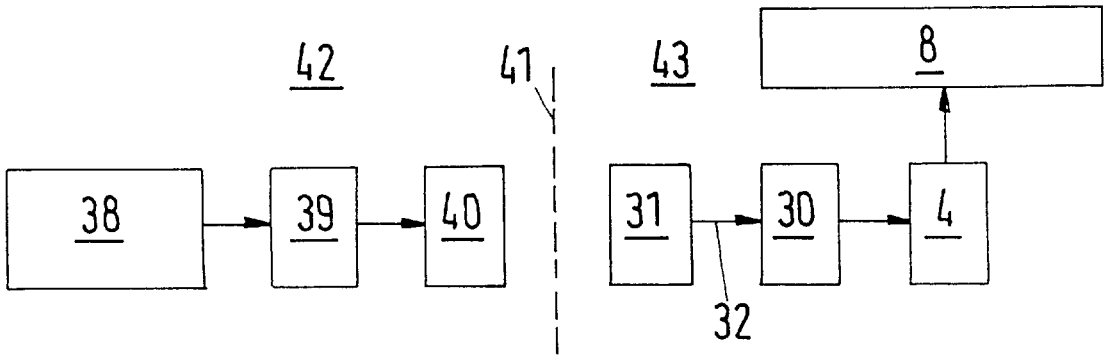
FIG. 3 is a logic diagram showing the process sequence.

Referring now to FIG. 3*a*, a logic diagram is illustrated. A roll cutting and winding facility 39 is disposed at the exit of a paper machine 38. The web of base paper, which has the same width as the paper machine, is cut into narrower webs in the roll cutting and winding facility. The cut narrower webs are then wound into individual rolls. These rolls, which have a lesser width than the base paper, are packaged in a packaging station 40. A dashed line 41 schematically represents the border between a paper factory 42 and a printing plant 43, which can be at any distance from one another. In the printing plant 43, the web is unwound in an unwinding station 31, directed through a coating machine 30 and a calender 4, and is directed to a printing machine 8, without any kind of intermediate winding. In this case, web 32 undergoes the effects of a coating machine 30, and then directly undergoes the effects of a calender 4.

Printing machines other than the illustrated eight-color gravure, web-fed rotary press can be used. For example, printing machines that work by means of high-pressure or planographic printing can be used. Additionally, calenders other than the illustrated seven roller gap calender 4 can be used. For example, a calender having a stack that is comprised of a greater number of rollers, or a calender with a smaller number of rollers can be used. Thus, for example, a soft calender that has one roller gap or two roller gaps connected one after the other could be used without departing from the spirit of the present invention.

Having described the presently preferred exemplary embodiment of a process for converting and printing on webs, and a printing machine for carrying out this process in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A process of converting and printing on paper webs comprising the steps of:

converting an unconverted running web of a base paper with a calender that includes a roller stack comprised of at least one hard roller and at least one soft roller, a roller gap being formed at the juncture of one of said hard rollers and one of said soft rollers;

prior to rolling said converted web, printing on the converted web; and cutting the web before the converting step so that the web is cut to the width required for printing.

2. The process according to claim 1, further comprising the step of:

directing the base paper from a paper machine directly to the cutting step;

winding the cut web into a roll; and unwinding the web from the roll before the converting and printing step.

3. The process according to claim 1, further comprising the step of tempering the converted web before the printing step.

4. The process according to claim 2, further comprising the step of tempering the converted web before the printing step.

5. The process according to claim 1, wherein said converting step is carried out by a coating machine.

6. The process according to claim 1, wherein said converting step is carried out by a coating machine and subsequently by a calender.

7. An apparatus for printing on converted paper webs comprising:

a calender for converting an unconverted web of base paper, said calender including a roller stack comprised of at least one hard roller and at least one soft roller, a roller gap being formed at the juncture of one of said hard rollers and one of said soft rollers; and a printing machine having an entrance for receiving the converted web from said calender;

wherein the pass-through speed of the web through said calender matches the pass-through speed of the converted web through said printing machine.

8. The apparatus according to claim 7, wherein the working width of said calender is approximately equal to a working width of said printing machine.

9. The apparatus according to claim 8, further comprising a tempering facility, which affects the web temperature, disposed between an exit of said calender and said entrance to said printing machine.

10. The apparatus according to claim 7, further comprising a coating device, which applies a coating dye to said web of paper, disposed upstream of an entrance to said calender.

* * * * *